United States Patent [19]

Cacolici

[11] 4,094,564

[45] June 13, 1978

[54] MULTIPLE CONDUCTOR ELECTRICAL CONNECTOR WITH GROUND BUS

[75] Inventor: Santo J. Cacolici, Mentor, Ohio

[73] Assignee: A P Products Incorporated, Painesville, Ohio

[21] Appl. No.: 778,580

[22] Filed: Mar. 17, 1977

[51] Int. Cl.[2] ..... H01R 3/06

[52] U.S. Cl. ..... 339/14 L; 339/22 B; 339/222

[58] Field of Search ..... 339/14 R, 14 L, 17 F, 339/22 B, 103 R, 105, 99 R, 19, 220 R, 222

[56] References Cited

U.S. PATENT DOCUMENTS

| | | | |
|---|---|---|---|
| 3,768,067 | 10/1973 | Rault | 339/14 R X |
| 4,005,921 | 2/1977 | Hadden et al. | 339/22 B X |
| 4,030,799 | 6/1977 | Venaleck | 339/99 R |

*Primary Examiner*—Roy Lake
*Assistant Examiner*—DeWalden W. Jones
*Attorney, Agent, or Firm*—Maky, Renner, Otto & Boisselle

[57] ABSTRACT

A grounding bus is provided directly within a multiple conductor electrical connector, such as a cable termination, to offer a common ground connection for selected ground conductors of a multiconductor cable attached thereto. The signal carrying conductors are connected to respective contacts of the connector, as usual, to facilitate connection to external circuitry, and a molded strain relief that dissipates applied strain without affecting the connections of the respective conductors and contacts is provided.

22 Claims, 4 Drawing Figures

MULTIPLE CONDUCTOR ELECTRICAL CONNECTOR WITH GROUND BUS

BACKGROUND OF THE INVENTION

The present invention relates generally, as indicated, to multiple conductor electrical connectors and, more particularly, to such a connector that may be used in conjunction with a multiconductor cable to form a cable termination assembly having an internal grounding bus and improved molded strain relief.

The use of multiconductor electrical cables in the electronics industry is, of course, widespread. One such multiconductor cable includes a plurality of individual wires, each including a conductor covered by its own insulation, bundled together mechanically, e.g. by a fasterner, an external sheath, or the like. Another such cable includes a plurality of electrical conductors contained in and electrically isolated from each other by a unitary body of electrical insulation. Flat or ribbon cable is a particular version of this latter multiconductor electrical cable type, as is well known. The insulation ribbon cable may be of various electrically non-conductive materials, such as plastic or plastic-like materials, polytetrafluoroethylene (e.g. Teflon), fiberglass, or like materials. Flat ribbon cables may have multiple conductors therein numbering more than eighty.

In some uses, such as for high speed signal transmission, of ribbon cable, it has been found desirable to provide an electrical ground potential or other reference electrical potential (hereinafter ground isolation) between signal carrying conductors by connecting alternate conductors (hereinafter ground conductors) of such a flat cable to a ground reference potential, for example. Moreover, for high speed signal transmission purposes woven ribbon cable and cables having Teflon or like insulation have been found most desirable.

Various techniques have been employed to terminate multiconductor cables, for example, by connection of the conductors thereof to respective electrical contacts that may be grouped in a male or female socket-like electrical connector device (hereinafter cable termination) to facilitate electrical connection of such conductors to other circuits, such as those terminating at terminal sockets of a computer module or the like. Such a cable termination assembled to a multiconductor cable is referred to as a cable termination assembly. In one such technique the ribbon cable, a plurality of electrical contacts, and several non-conductive body parts are placed in a jig press and using the latter are secured together mechanically to form a cable termination assembly. Another technique for terminating multiconductor cables disclosed in commonly assigned U.S. patent application Ser. No. 656,303, filed Feb. 2, 1976, now U.S. Pat. No. 4,030,799, issued June 2, 1977, provides for direct penetration of electrical contacts through the cable insulation to connect with respective conductors therein and a body of dielectric material molded directly about at least part of the contacts and cable to secure the same as an integral structure.

In the past, to obtain ground isolation for such multiconductor ribbon cables the ground conductors were connected to respective contacts of the cable termination assembly and each of these contacts were in turn connected to an external ground. Therefore, usually less than half of the remaining contacts of the cable termination assembly, i.e. those coupled to the respective signal carrying conductors, were actually available to carry useful signals.

Strain relief, i.e. a mechanism that prevents force applied to the cable termination assembly tending to separate the termination from the cable from detrimentally affecting the integrity of the connections between respective conductors and contacts, is provided in the above mechanically assembled cable termination assembly by applying a mechanical binding force to the cable to secure it between several body parts. In the molded cable termination assembly strain relief is provided by the intimately engaged insulation and molded body therearound also preferably with a chemical bond being obtained between the insulation and the molded body. Moreover, in commonly asigned copending U.S. patent application Ser. No. 752,469, filed Dec. 20, 1976, there is disclosed a lip seal insert for securing an electrical cable having insulation of a material, for example, of Teflon, that ordinarily will not readily bond with the molded body in the latter to provide the strain relief function.

SUMMARY OF THE INVENTION

In the present invention a grounding bus is provided directly within a multiple conductor electrical connector, such as a cable termination, to offer a common ground connection for selected ground conductors of a multiconductor cable attached thereto. The signal carrying conductors are connected to respective contacts of the connector, as usual, to facilitate connection to external circuitry, and a molded strain relief that dissipates applied strain without affecting the connections of the respective conductors and contacts is provided.

Although one or more of the contacts themselves may be coupled to the grounding bus for connection to an external circuit ground, if desired, the internal grounding bus frees more of the contacts for signal carrying purposes than was possible in the past while desired ground isolation is still provided.

The molded strain relief mechanism securely holds the multiconductor cable in the connector in order to form a secure, integral cable termination assembly therewith. To obtain this strain relief, the cable extends out of the strain relief body, which is molded directly about part of the cable, in a direction that is angularly displaced from the insertion and withdrawal direction of the connector contacts. Therefore, a force tending to separate the cable from the connector would be dissipated in the molded strain relief body without detrimentally affecting the connections between the respective conductors and contacts which also preferably are encased within the molded strain relief body. Moreover, this angular exit of the cable from the strain relief body facilitates close packing of plural similar cable termination assemblies.

With the foregoing in mind, it is a primary object of the invention to provide a multiple conductor electrical connector, such as a cable termination, that is improved in the noted respects.

Another object is to increase the number of signal carrying contacts of a cable termination assembly while maintaining ground isolation of respective signal carrying conductors.

An additional object is to relieve the strain applied between the connector and cable of a cable termination assembly by dissipating such strain in a molded strain relief body.

A further object is to facilitate terminating multiconductor cables, especially those having ground-signal-ground conductor patterns, for example, for high speed signal transmission uses.

Still another object is to provide an internal grounding bus for a cable termination assembly.

Still an additional object is to provide a compact, secure, relatively inexpensive means for terminating high speed transmission multiconductor cables with common grounding for selected conductors thereof.

Still a further object is to facilitate common grounding or the like of plural conductors of a multiconductor cable terminating in a connector associated therewith.

Even another object is to facilitate close packing of cable termination assemblies.

These and other objects and advantages of the invention will become more apparent as the following description proceeds.

To the accomplishment of the foregoing and related ends, the invention, then, comprises the features hereinafter fully described in the specification and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
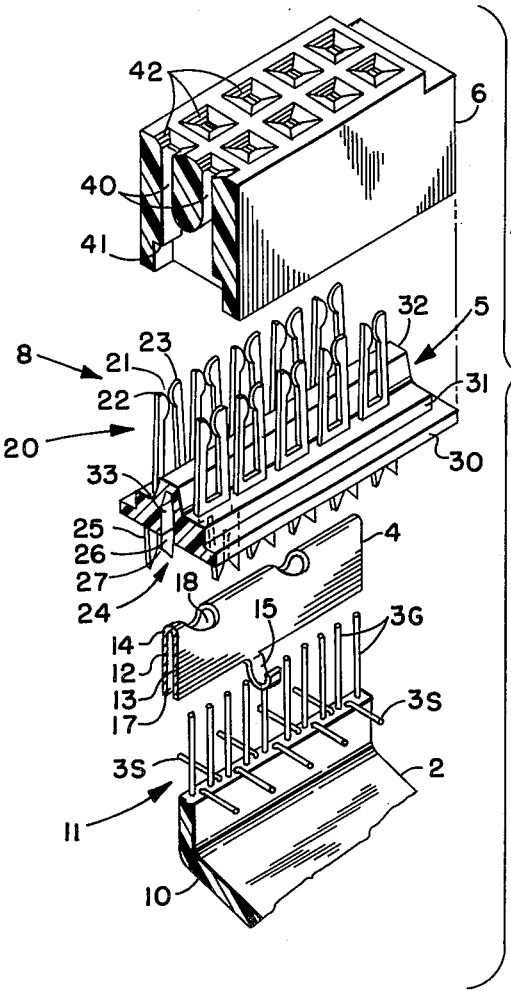
FIG. 1 is an exploded isometric view, partly broken away in section, of an electrical connector in accordance with the invention.
Figure 2:
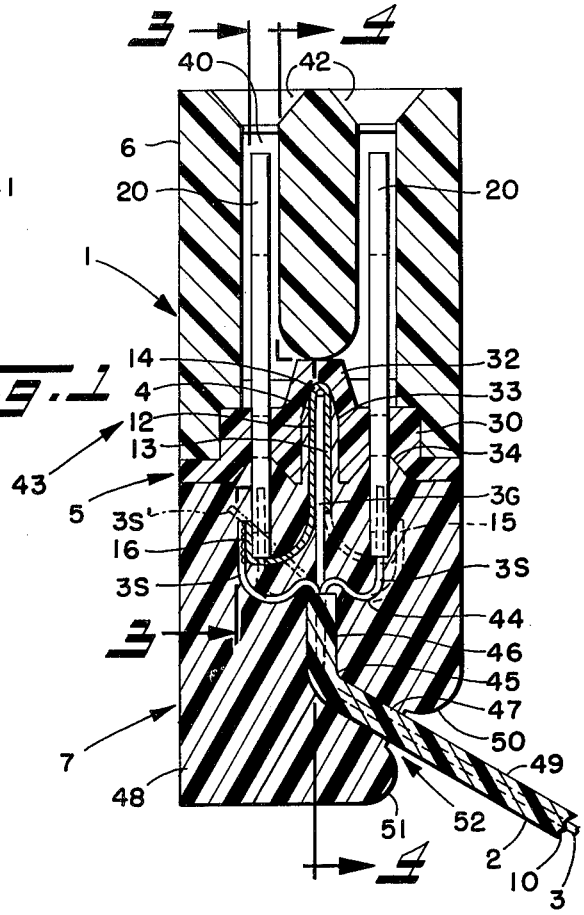
FIG. 2 is a section view of the electrical connector of FIG. 1 with several of the cable conductors out of plane.
Figure 3:
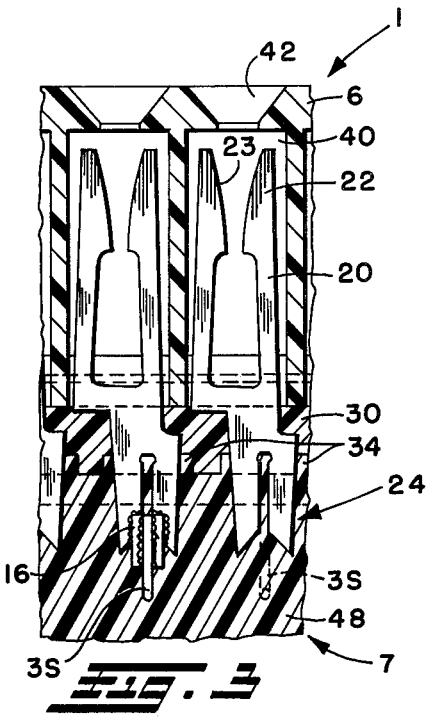
FIG. 3 is a partial section view of the electrical connector of FIG. 2 looking generally in the direction of the arrows 3—3 thereof.
Figure 4:
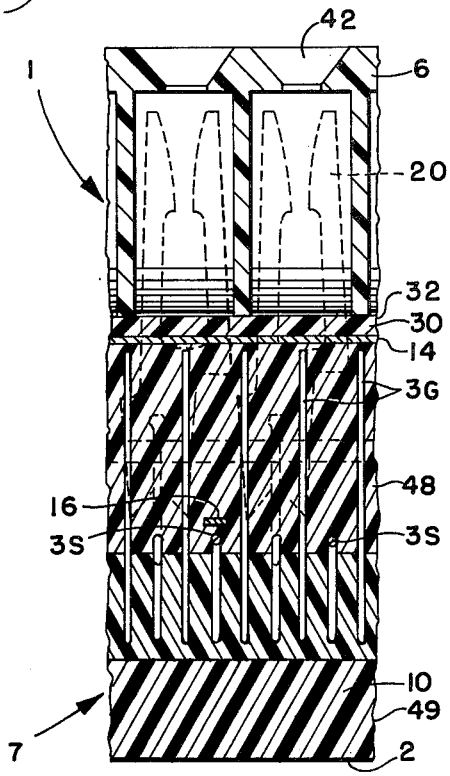
FIG. 4 is a partial section view of the electrical connector of FIG. 2 looking generally in the direction of the off-set arrows 4—4 thereof.

Referring now in detail to the drawing, a multiple conductor electrical connector in the form of a cable termination assembly is generally indicated at 1 in FIGS. 1–4. The fundamental elements of the assembly 1 include a multiconductor electrical cable 2 which has a plurality of electrical conductors generally designated 3, a grounding bus 4, a contact carrier sub-assembly 5, and a nose cap or cover 6, as are illustrated in FIG. 1; the assembly 1 also includes a strain relief mechansim 7, which has been deleted from FIG. 1 for clarity but is shown in FIGS. 2, 3 and 4. The several elements 3–7 of the assembly 1 may be considered the electrical connector portion 8 thereof for terminating the cable 2.

In a preferred embodiment of the invention the multiconductor electrical cable 2 has, for example, 81 conductors 3 of which alternate conductors 3G, including the first and the eighty-first are intended to be connected to a source of reference potential, such as a ground reference potential, to provide ground isolation for the remaining signal carrying conductors 3S. The insulation 10 for the cable 2 in the illustrative embodiment is of Teflon or like material that has desirable impedance characteristics suitable for high speed signal transmission by the signal carrying conductors 3S therein. Moreover, Teflon material insulation also has been found desirable to maintain the many conductors 3 therein electrically isolated from each other, thereby to assure the electrical integrity of the cable 2. The insulation is stripped from the end 11 of the cable 2 to bare the conductors 3. Although the ground conductors 3G extend in their customary linear direction from the insulation 10, the signal carrying conductors 3S are alternately bent in opposite directions, as shown in FIG. 1, for example to extend generally perpendicularly to the linear extent of the ground conductors.

Each of the ground conductors 3G is mechanically and electrically coupled to the grounding bus 4 which maintains them at a common potential, in this case at ground potential. The grounding bus 4 may be formed of copper or other electrically conductive material in the form of a flat strip that is bent in half to form opposed clamping faces 12, 13 coupled along a folded edge 14. One or more tabs 15 (FIGS. 1 and 2) and 16 (FIG. 2) may extend outwardly from respective clamping faces 12, 13 for connection with respective signal carrying conductors 3S and/or electrical contacts of the contact carrier sub-assembly 5, as will be described further below. Before the grounding bus 4 is folded, the strip material thereof may be coated with solder.

The ground conductors 3G and the grounding bus 4 are assembled by inserting the ground conductors between the two clamping faces 12, 13, which are then further urged toward each other to clamp the ground conductors within the space 17 therebetween. Heat then is applied to the grounding bus 4 to form a soldered connection with the respective ground conductors 3G. Openings 18 in the grounding bus 4 may be provided to release gases generated during the soldering operation.

The contact carrier sub-assembly 5 includes a plurality of electrical contacts 20, each having a connecting portion 21 in the form of a conventional fork contact formed by a pair of tines 22, 23 between which a conventional pin contact or the like may be inserted for electrical engagement therewith. Each of the contacts 20 also has a junction portion 24 including a pair of arms 25, 26 separated by a slot 27 with the arms and slot being cooperable to receive one of the signal carrying conductors 3S to form an electrical junction therewith. The contacts 20 are arranged on the contact carrier sub-assembly in a dual-in-line pattern, although if desired other patterns may be employed using the same or different numbers of rows of contacts. Moreover, the respective junction portions 24 of the contacts in one of the two rows of contacts are offset in one direction while those of the contacts in the other row are offset in the relative opposite direction, as can be seen more clearly in FIGS. 3 and 4, to facilitate relatively close packing of the contacts 20 and conductors 3 in the cable 2. If desired, of course, the contacts 20 may be of other female, male or hybrid types.

An electrically non-conductive carrier body 30 of the contact carrier sub-assembly 5 is molded, for example by injection molding techniques, directly about at least a portion of each of the contacts 20 to secure them in the illustrated spaced-apart pattern relationship. The carrier body 30 may be formed, for example, of Valox, which is a glass-filled polyester that has suitable strength and dielectric properties and may be used conveniently in injection molding processes. As can be seen most clearly in FIGS. 1 and 2, the carrier body 30 has an external step 31, an external divider wall 32 that separates the two rows of contacts 20, and an internal elongate groove 33. Moreover, the carrier body 30 has a plurality of recesses 34 (FIG. 2) where the respective junction portions 24 of the contacts 20 exit the carrier body to assure that during molding of the carrier body about the contacts no molding material will enter the slots 27 clogging or blocking the same.

A plurality of compartments 40 in the cover 6, which also may be injection molded of Valox material or the like, receive the respective connecting portions 21 of the contacts 20 when the cover is secured to the carrier body 30 of the contact carrier sub-assembly 5, for example by ultrasonic welding. An internal step 41 in the cover 6 substantially mates with the external step 31 of the carrier body 30 to facilitate aligning the latter and the cover. A plurality of openings 42 provide respective entrance ways for guiding a plurality of pin contacts into the compartments 40 for mechanical and electrical engagement with respective connecting portions 21 of the contacts 20.

Ordinarily the contact carrier sub-assembly 5 and the cover 6 would be assembled to form a terminal-like portion 43 of the cable termination assembly 1. The terminal-like portion 43 and the already joined grounding bus 4 and multiconductor electrical cable 2, i.e. the grounding bus being secured in the above-described manner to the respective ground conductors 3G, then are brought together. More specifically, the grounding bus 4 with the ground conductors 3G clamped therein between the clamping faces 12, 13 is inserted into the groove 33 of the carrier body 30 to the position shown most clearly in FIG. 2. Each of the signal carrying conductors 3S is then inserted into respective slots 27 of the contact junction portions 24 to engage one or both of the respective pairs of arms 25, 26 thereof, and the tabs 15, 16 of the grounding bus 4 also are bent to abut respective contacts adjacent slots 27 in the manner illustrated in FIG. 2 for electrical connection with respective contacts 20 and, ordinarily, with one of the signal carrying conductors 3S, which would, of course, be at the same reference potential as the grounding bus. Those conductors 3S which couple to contacts 20 that connect to tabs 15, 16 may be bent to abut the tabs themselves or to abut the contacts adjacent and/or in a slot, or both, and solder may be applied around those tabs, conductors and contacts to secure them electrically and mechanically. As is illustrated in FIG. 2, for example, each of the signal carrying conductors 3S may be looped slightly at 44 and then inserted linearly into the slot 27 of a respective junction portion 24 or, alternatively, the signal carrying conductors may be otherwise inserted into respective slots 27, for example while extending angularly with respect to the linear extent of the slot as is shown in phantom at 3S' in FIG. 2. The loops 44 may be formed and the signal carrying conductors 3S inserted into respective slots 27 by individual manual operations. Alternatively, if the signal carrying conductors 3S have a suitable strength, and the various dimensional characteristics of the grounding bus 4 and the ground conductors 3G are properly selected, the signal carrying conductors 3S of FIG. 1 may be slid into respective slots 27 as the grounding bus 4 simultaneously is inserted into the groove 32. Preferably, each of the electrical junctions formed between respective signal carrying conductors 3S and junction portions 24 of the contacts 20 is secured further by applying solder to the same, thereby to assure the mechanical and electrical integrity of such junctions.

The strain relief mechanism 7 now may be applied to the thusly assembled terminal-like portion 43, grounding bus 4, and cable 2. First, a bend 45 is formed in the cable 2 at a portion where the insulation 10 still remains intact so that a linearly extending portion 46 of the insulation is located above the bend directed generally parallel relative to the major directional extents of the contacts 20 and an angularly extending portion directed away from the contacts generally angularly with respect to the mentioned major directional extent thereof is located below the bend. The bent cable 2, grounding bus 4, and terminal-like portion 43 are then placed in an injection molding machine, for example, and a quantity of dielectric material, for example also of Valox, is molded directly to and about the bent cable, the exposed conductors 3G, 3S, and the exposed portions of the grounding bus 4 to form the strain relief body 48, as shown most clearly in FIGS. 2, 3 and 4. The strain relief body 48 seals the respective electrical junctions of the signal carrying conductors 3S with the junctions portions of the contacts 20, of the tabs 15, 16 with respective junction portions 24, and of the ground conductors 3G with the grounding bus 4. Moreover, preferably portions of the strain relief body 48 fill the respective recesses 34 in the carrier body 30 and the voids remaining in the groove 33 and between adjacent ground conductors 3G in the grounding bus 4, thus becoming mechanically integral therewith.

The strain relief mechanism 7, including the bend 45 in the cable 2 and the directly molded strain relief body 48 impede the transmitting of a strain force to the junctions of the conductors 3 to the contacts 20 and to the grounding bus 4, respectively. More specifically, relatively oppositely directed forces applied respectively to the external portion 49 of the cable 2 and to the strain relief body 48, either directly to the latter or via the connecting portions 21 of the contacts 20 or the cover 6, will tend to be dissipated within the strain relief body to avoid transmitting such strain beyond the bend 45 to the linear extending portion 46 of the cable 2, thereby also preventing the strain from affecting the junctures of the conductors with the contacts and grounding bus.

The loops 44 in the signal carrying conductors 3S further impede the transmission of strain to the junctures of those conductors with the respective contact junction portions 24 both during the molding process of the strain relief body 48 and thereafter.

A pair of radii 50, 51 adjacent the location 52 at which the cable 2 exits the strain relief body 48 facilitate bending of the cable relative to the strain relief body without breaking the insulation 10 or the conductors 3 therein. Moreover, the angular direction at which the cable 2 exits the strain relief body 48 facilitates close packing of several cable termination assemblies 1 on a common terminal board or the like maintaining a low profile with the respective cables being placed in stacked layers, if desired.

In view of the foregoing, it will be understood that each of the signal carrying conductors 3S is both provided with ground isolation by respective ground conductors 3G on opposite sides thereof and terminated at respective contacts 20 for facile electrical connection to external circuitry. If desired, one or more of the ground conductors may be coupled at a remote end of the cable 2, not shown, to a source of a ground reference potential, thereby applying that reference potential to the grounding bus 4 and the remaining ground conductors 3G. Moreover, the tabs 15, 16 at selected locations, as desired, along the grounding bus 4 form an electrical connection with respective pairs of aligned signal carrying conductors 3S and junction portions 24 of contacts 20, thereby to assure that those contacts and conductors also are maintained at the same potential as the grounding bus 4 either to transmit that potential externally of the cable termination assembly 1 or to receive that reference potential from external circuitry coupled via pin contacts, for example, not shown, to the respective contacts 20. Accordingly, a large majority or, if desired, even all of the contacts 20 and signal carrying conductors 3S may be employed for signal carrying purposes while the grounding bus 4 and ground conductors 3G maintain ground isolation.

Thus, in the illustrative embodiment using a cable with 81 conductors and 40 contacts 20, the forty signal carrying conductors 3S would be coupled to respective contacts 20 and would be provided with ground isolation by the remaining alternative forty-one ground conductors 3G coupled to the internal grounding bus 4. The grounding bus may have four tabs 15, 16, or any other number, as desired, only two of which are seen in the drawing. Then, since four of the signal carrying conductors 3S would be at ground potential due to connections to the tabs 15, 16, a full thiry-six of the signal carrying conductors and contacts attached thereto would be available for signal transmission or connecting purposes.

I, therefore, particularly point out and distinctly claim as my invention:

1. A cable termination assembly comprising a multiconductor cable, a plurality of contacts connected electrically to respective conductors of said cable, bus means for electrically connecting respective conductors of said cable, and dielectric body means for holding together said contacts, said bus means, and said cable, said body means including carrier means molded directly about and to said contacts for holding the same in a fixed pattern, said carrier means also including further means for holding said bus means thereto in electrical isolation from at least one of said contacts.

2. The assembly of claim 1, wherein said bus means is coupled to alternate conductors to maintain the same at a common reference potential, thereby to provide reference potential isolation for the remaining signal carrying conductors connected to respective contacts.

3. The assembly of claim 1, wherein said carrier means holds said contacts in dual-in-line pattern, and said further means comprises groove means in said carrier means for receiving said bus means.

4. A cable termination assembly comprising a multiconductor cable, a plurality of contacts connected electrically to respective conductors of said cable, bus means for electrically connecting respective alternate conductors of said cable to maintain the same at a common reference potential, thereby to provide reference potential isolation for the remaining signal carrying conductors connected to respective contacts, and dielectric body means for holding together said contacts, said bus means, and said cable, said body means including a carrier body means molded directly about and to said contacts for holding the same in a fixed dual-in-line pattern, said carrier body means including groove means therein for receiving said bus means and holding said bus means to said carrier body means in electrical isolation from at least one of said contacts, and said bus means comprising folded conductive strip means for clamping respective conductors thereto, said conductive strip means being inserted fold-first into said groove means.

5. The assembly of claim 4, wherein said bus means includes tab means for electrically connecting the same with respective contacts.

6. The assembly of claim 5, wherein said body means further includes strain relief means for securing said cable in the connector to maintain the integrity of mechanical and electrical connections of the conductors, contacts and bus means when strain is applied to the cable termination assembly, said strain relief means comprising a strain relief body molded directly about and to at least a portion of each of said contacts, conductive strip means, tab means, conductors, and the cable insulation, and wherein said cable, including its conductors and insulation, has a bend therein encased in said strain relief body to dissipate applied strain forces therein.

7. The assembly of claim 1, wherein said contacts comprise female type contacts, and wherein the connector further comprises cover means for enclosing said female type contacts, said cover means including opening means therein for guiding male type contacts to engagement with respective ones of said female type contacts.

8. The assembly of claim 1, wherein each of said contacts has a connecting portion means extending on one side of said carrier means for connecting with an external contact inserted to engagement therewith and a junction portion means for connecting with respective conductors of said cable.

9. A cable termination assembly comprising a multiconductor cable, a plurality of contacts connected electrically to respective conductors of said cable, bus means for electrically connecting respective conductors of said cable, and dielectric body means for holding together said contacts, said bus means, and said cable, said body means comprising a carrier body molded directly about and to said contacts, each of said contacts having a connecting portion means extending on one side of said carrier body for connecting with an external contact inserted to engagement therewith and a junction portion means for connecting with respective conductors of said cable, said carrier body including holder means for holding said bus means thereto, said holder means comprising a groove in said carrier body, and said bus means comprising a folded conductive strip clamped to respective conductors and inserted fold-first into said groove.

10. The assembly of claim 9, wherein said bus means further comprises solder means thereon for forming a soldered joint with the respective conductors clamped thereto.

11. The assembly of claim 9, wherein said bus means further comprises tab means extending outwardly from said folded conductive strip for connecting to at least one junction means of said contacts.

12. The assembly of claim 8, wherein said contacts are substantially identical and said carrier means holds said contacts in dual-in-line pattern, wherein said cable comprises ribbon type cable having a plurality of elongate conductors in an insulative material, and wherein a plurality of alternate ones of said conductors are coupled to said bus means and a plurality of the remaining conductors are coupled to respective contacts alternately in the respective rows thereof.

13. The assembly of claim 8, wherein said junction portion means includes slot means for receiving respective conductors, and wherein said carrier means includes recess means therein for blocking entry of material forming said carrier means into said slot means during molding of said carrier means.

14. The assembly of claim 1, wherein said body means further includes strain relief means for securing said cable in the connector to maintain the integrity of mechanical and electrical connections of the conductors, contacts, and bus means when strain is applied to the cable termination assembly.

15. The assembly of claim 14, wherein said strain relief means comprises a strain relief body molded directly about and to at least a portion of each of said contacts, conductive strip means, conductors, and cable insulation, and wherein said cable, including its conductors and insulation, has a bend therein encased in said strain relief body to dissipate applied strain forces therein.

16. A cable termination assembly including an electrical cable having insulation and at least one exposed conductor electrically coupled to contact means for terminating the same, dielectric body means for encasing at least a portion of said contact means, said insulation, and said exposed conductor ordinarily to secure the same in relatively fixed locations, said body means comprising a strain relief body molded directly about and to said portions, and said electrical cable having distinct bend means therein located within said body means for dissipating strain in the latter thereby to maintain the integrity of the connection between said exposed conductor and said contact means.

17. The assembly of claim 16, wherein a portion of said insulation and said exposed conductor are positioned in said body means extending generally parallel with respect to the operative direction extent of said contact means, and wherein a portion of said cable extends angularly with respect to such generally parallel extent, thereby to form said distinct bend.

18. The assembly of claim 17, wherein said exposed conductors is formed in at least a partial loop between said insulation and the junction with said contact means.

19. The assembly of claim 17, further comprising radius means on said body means where said electrical cable exits the same for facilitating bending of said electrical cable relative to said body means without damage to said electrical cable.

20. A cable termination assembly comprising a multiconductor cable, a plurality of contacts connected electrically to respective conductors of said cable, bus means for electrically connecting respective conductors of said cable, said bus means comprising folded conductive strip means for clamping respective conductors thereto, and dielectric body means for holding together said contacts, said bus means, and said cable.

21. A cable termination assembly comprising a multiconductor cable, a plurality of contacts connected electrically to respective conductors of said cable, bus means for electrically connecting respective conductors of said cable, and dielectric body means for holding together said contacts, said bus means, and said cable, said bus means being coupled to alternate conductors to maintain the same at a common reference potential, thereby to provide reference potential isolation for the remaining signal carrying conductors connected to respective contacts, said contacts being positioned in two parallel rows, and said signal carrying conductors alternately being connected, respectively, to respective contacts alternately in the respective rows thereof.

22. The assembly of claim 21, wherein said contacts are substantially identical in size and shape and are held in dual-in-line pattern.

* * * * *